US005735394A

United States Patent [19]

Harrelson

[11] Patent Number: 5,735,394

[45] Date of Patent: Apr. 7, 1998

[54] CARRIER WITH TEAR RESISTANT HANDLE

[75] Inventor: Glen Ray Harrelson, Gainesville, Ga.

[73] Assignee: Riverwood International Corporation, Atlanta, Ga.

[21] Appl. No.: 748,934

[22] Filed: Nov. 13, 1996

[51] Int. Cl.[6] ..... B65D 71/40

[52] U.S. Cl. ..... 206/151; 206/158

[58] Field of Search ..... 206/139, 141, 206/145–149, 151–158, 161, 162, 167, 168, 174–177, 193–195, 199, 427, 428

[56] References Cited

U.S. PATENT DOCUMENTS 2,849,112 8/1958 Forrer ..... 206/154

4,017,017 4/1977 Vos ..... 229/117.14

5,311,984 5/1994 Harris ..... 206/434

5,582,289 12/1996 Wright ..... 206/162

*Primary Examiner*—Jimmy G. Foster

[57] ABSTRACT

A bottle carrier having a suitcase-type handle connected to the top panel by spaced fold line segments. The top panel of the carrier includes apertures adjacent the outer ends of the outer fold line segments. Tabs at the outer ends of the handle extend through the apertures into the interior of the carrier, thereby preventing tearing at the handle when lifting and carrying the carrier. The top panel is comprised of partially overlapping top panel sections, and a central tab integral with the overlapping top panel section extends through the central opening of the suitcase type handle.

15 Claims, 3 Drawing Sheets

CARRIER WITH TEAR RESISTANT HANDLE

FIELD OF THE INVENTION

This invention relates to carriers which employ so-called suitcase type handles, that is, upright handles which have a transverse strap that can be gripped by a person lifting the carrier. More particularly, it relates to carriers of this type which are provided with handles that are resistant to tearing.

BACKGROUND OF THE INVENTION

One type of carrier for packaging beverage bottles employs support tabs which are spaced along the edges of bottle neck openings in a carrier support panel. When the panel is pushed down over bottles aligned with the neck openings, the tabs are pivoted up so that their end edges engage the underside of the flanges or shoulders typically formed on such bottles. A handle, in many cases comprised of finger holes in the support panel, allows the carrier to be grasped and lifted.

Instead of finger holes, most consumers prefer an upwardly extending handle which can be gripped in the manner of a suitcase handle. A desirable arrangement from the standpoint of economy, ease of fabrication and the ability to provide a two-ply handle of adequate strength would be a handle which is foldably connected to the top panel. It has been found, however, that the handle tends to tear at the ends of the foldable connection when subjected to heavy loads or when lifted in a sudden fast movement. It would be highly desirable to strengthen the handle to resist tearing without interfering with the simplicity and economy of the carrier.

It is therefore an object of the invention to provide a carrier which employs a strong suitcase-type handle which meets these goals.

BRIEF SUMMARY OF THE INVENTION

The invention is incorporated in an article carrier including a top panel connected to side panels and a handle connected to the top panel by a fold line located substantially along a centerline of the carrier. The handle fold line is substantially parallel to the side edges of the top panel and has opposite ends terminating at points spaced from the end edges of the top panel. The top panel includes apertures extending from the ends of the handle fold line toward the end edges of the top panel. Downwardly extending tabs at opposite ends of the handle extend through the apertures in the top panel into the interior of the carrier to strengthen the carrier against tearing, as discussed in greater detail below.

In the preferred embodiment the handle is comprised of two plies, each being foldably connected to a top panel section, and the top panel sections are connected in a partially overlapping manner to form the top panel. The handle tabs are formed by slits in the top panel sections which, when the handles are folded into place when fabricating a carrier, result in the openings or apertures through which the handle tabs extend.

The handle is preferably of the suitcase handle type, with the handle fold line being comprised of two spaced fold line segments separated by the handle opening. The top panel is strengthened at the handle opening by an arrangement in which the overlapping top panel section includes an integral tab which extends through the handle opening and is adhered to the underlying top panel section. End panels may be provided if desired.

The carrier is formed from a single blank of material and can readily be fabricated. The features of the invention which enable it to provide the desired results are brought out in more detail in the description of the preferred embodiment, wherein the above and other aspects and benefits of the invention will be apparent.

DETAILED DESCRIPTION OF THE PREFERRED EMBODIMENT

Figure 1:
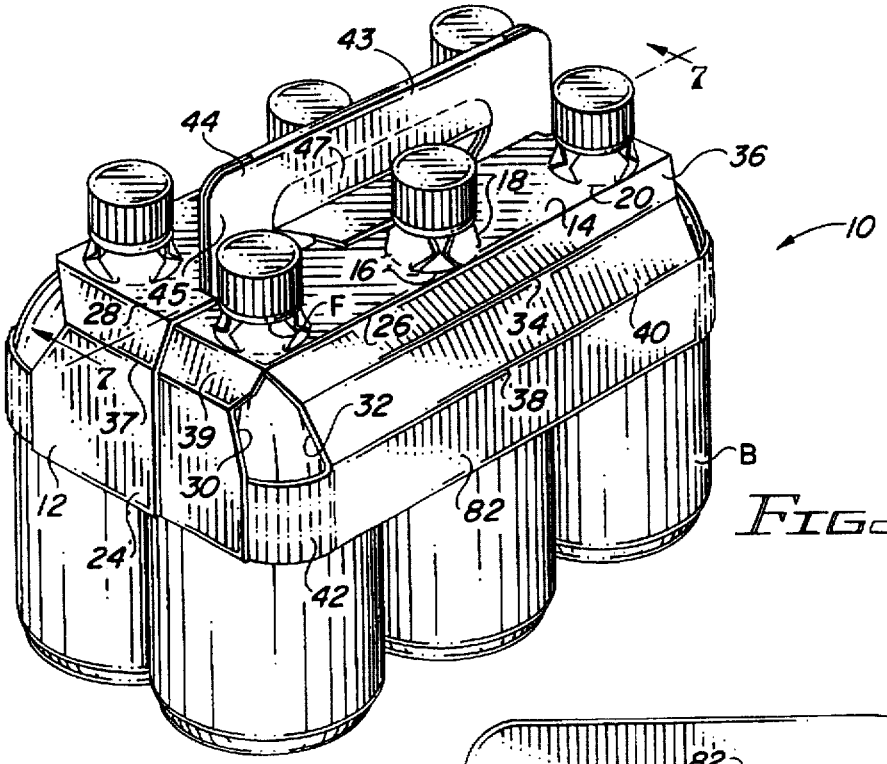
FIG. 1 is a pictorial view of a carrier embodying the invention.

Referring to FIG. 1, the package 10 is comprised of two rows of three bottles B and a carrier 12 for lifting and carrying the bottles. The carrier includes a top panel 14 containing openings 16 through which the necks of the bottles extend. The end edges of tabs 18, which are connected to the panel 14 by fold lines 20 extending about the periphery of the bottle neck openings 16, contact the underside of the flanges F on the bottles to support the bottles when the carrier is lifted. The top panel 16 is connected to side panels 22 and end panels 24 by fold lines 26 and 28, respectively, which are connected to each other at the corners of the carrier by the upper edges 30 of cutouts 32.

A fold line 34 in the side panels 22 extends between the cutouts 32, forming short sloped side panel sections 36 which generally conform to the relatively steep slope of the bottles in the upper portion of the transition area between the bottle neck and the barrel of the bottle. Another parallel fold line 38 in the side panels below the fold line 34 extends between the lower portion of the cutouts 32 to form intermediate side panel sections 40 of lesser slope than the panel sections 36. These panel sections correspond to and follow the lesser slope of the bottles in the lower portion of their transition area. The end panels 24 include fold line 37 spaced from the top panel the same distance as the fold lines 34 in the side panels, thus forming short sloped end panel sections 39 which, like the side panel sections 36, generally conform to the relatively steep slope of the end bottles in the upper portion of the transition area of the bottles. The side and end panels extend only partially down the length of the bottles, with rounded corner areas 42 connecting the side panels to the end panels to provide a tight fit. Extending upwardly from the top panel 14 is a suitcase-type handle 44 which is connected to the top panel along the longitudinal centerline of the carrier in a manner explained more fully below. The handle includes a horizontal strap 43, a pair of legs 45 extending from the strap to the top panel and a short flap 47 foldably connected to the strap portion of the handle.

Figure 2:
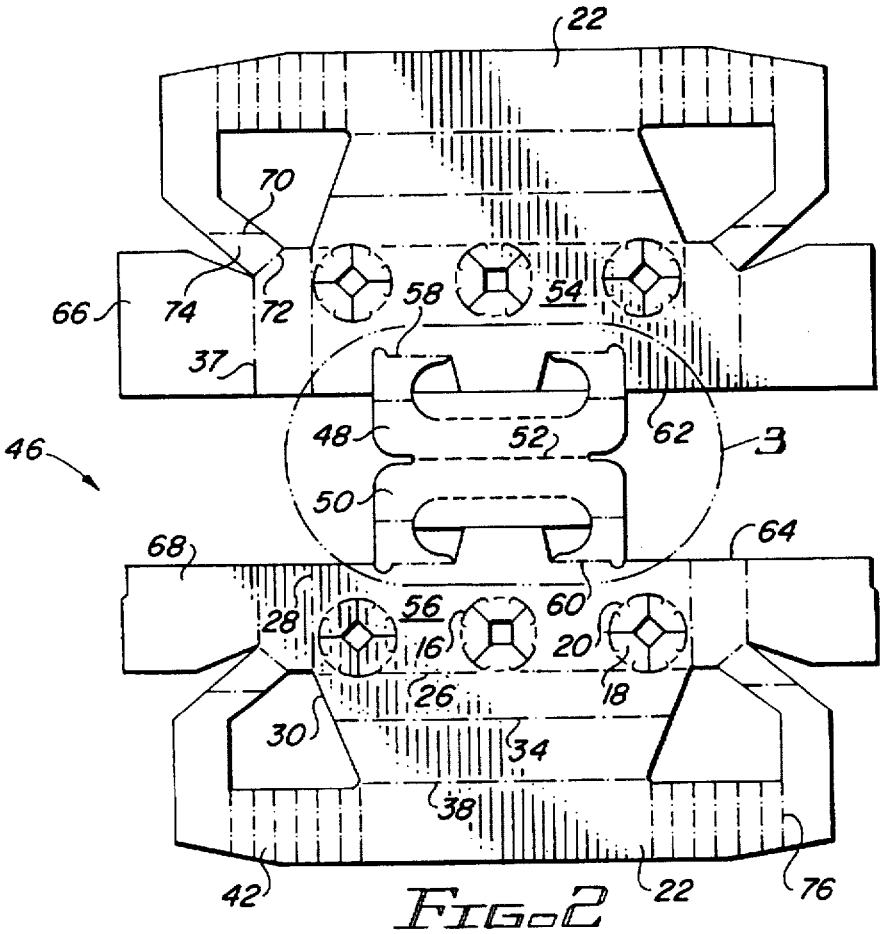
FIG. 2 is a plan view of a blank for forming the carrier of FIG. 1.

A blank 46 for forming the carrier is shown in FIG. 2, wherein like reference numerals to those used in FIG. 1 denote similar elements. The blank preferably is formed of paperboard, but may be of any suitable material having sufficient strength and flexibility to function in the manner of paperboard. The blank is comprised of two similar handle sections 48 and 50 which are connected to each other by fold line 52. The handle sections 48 and 50 are foldably connected to top panel sections 54 and 56, respectively, with the legs 45 of the handle section 48 being connected along spaced fold line segments 58 and the legs of the handle section 50 being connected along spaced fold line segments 60. Note that the fold line segments 58 are spaced from the inner edge 62 of the top panel section 54 while the fold line segments 60 coincide with the inner edge 64 of the top panel section 56. As shown, the side panel sections 20 include the fold lines 34 which form the sloped panel sections 38, and the fold lines 38 which form the sloped panel sections 40.

Each top panel section contains three bottle neck openings 16. Preferably, the support tabs 18 of the interior bottle neck openings are arranged so that the fold line 20 of the outer tab coincides with the fold line 26. This gives additional support strength to the tabs. The support tabs of the outer bottle neck openings, however, are arranged so that the fold lines of the outer tabs form a diagonal with the fold lines 26 and 28. If the outer support tabs were arranged as the interior support tabs, the tab forming slits would be too closely spaced to the corner of the top panel of a carrier, possibly weakening the corner areas of the top panel.

Connected to opposite ends of the top panel section 54 by fold lines 28 are end panel flaps 66. Similarly, end panel flaps 68 are connected to opposite ends of the top panel section 56 by fold lines 28. Each end panel flap includes a fold line 37 form forming the sloped sections 39 in the end panels of a carrier. Extending from opposite ends of the side panel sections 20 are side panel extensions 42 which form the rounded corners of the carrier. Connected to the side panel extensions 42 along fold line 70 and to the end panel flaps 66 and 68 along fold line 72 are gusset panels 74. The fold lines 70 are substantially parallel to the fold lines 34 and the fold lines 72 form an angle of 45° with the fold lines 28 and 34. The cutouts 30 are thus bounded by edges of the side panel sections 20, the side panel extensions 42, the gusset panels 74 and the end panel flaps 66 and 68. Groups of parallel spaced score lines 76, parallel to the fold lines 28, are located in the side panel extensions 42 to facilitate flexing of these elements during carrier formation.

Figure 3:
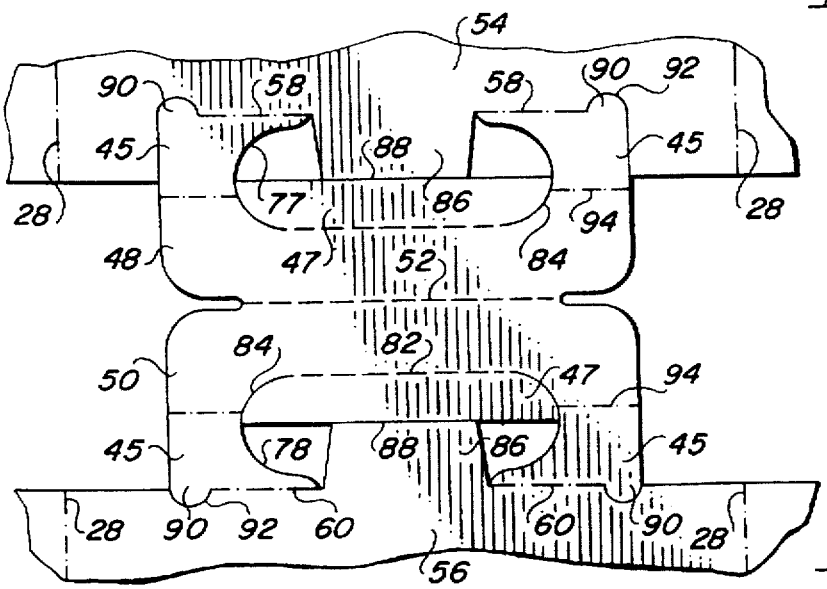
FIG. 3 is an enlarged partial plan view, showing the area within the oval 3 of FIG. 2.

Still referring to FIG. 2, and also to FIG. 3 for a more detailed showing of the handle sections, it can be seen that each handle section includes a handle opening 77 formed by cutouts 78. The handle grip flap 47 is connected to each handle section by fold line 82 and is separated at its ends from the handle section by arcuate slits 84. Each side panel section includes a centrally located integral tab 86 which extends into the cutouts 78 to the handle grip flap 47 and is separated from the flap 47 by slit 88. Each handle section includes an extension or tab 90 defined by arcuate slits 92. The tabs extend into the associated side panel section for a substantial distance beyond the fold lines 58 and 60. The outer ends of the fold lines 58 and 60 terminate at the slits 92. In addition, each handle section includes an intermediate fold line 94 extending from the ends of the handle section to the slit 84.

It can be seen in FIG. 2 that the width of the end panel flaps 66, as measured along fold line 28, is greater than the width of the end panel flaps 68 by an amount substantially equal to the distance that the fold lines 58 are spaced from the edge 62 of the top panel section 54. The width of the top panel section 54 adjacent the fold lines 28, as measured in the same direction as the end panel flaps, is greater than the width of the top panel section 56 by a similar amount.

Figure 4:
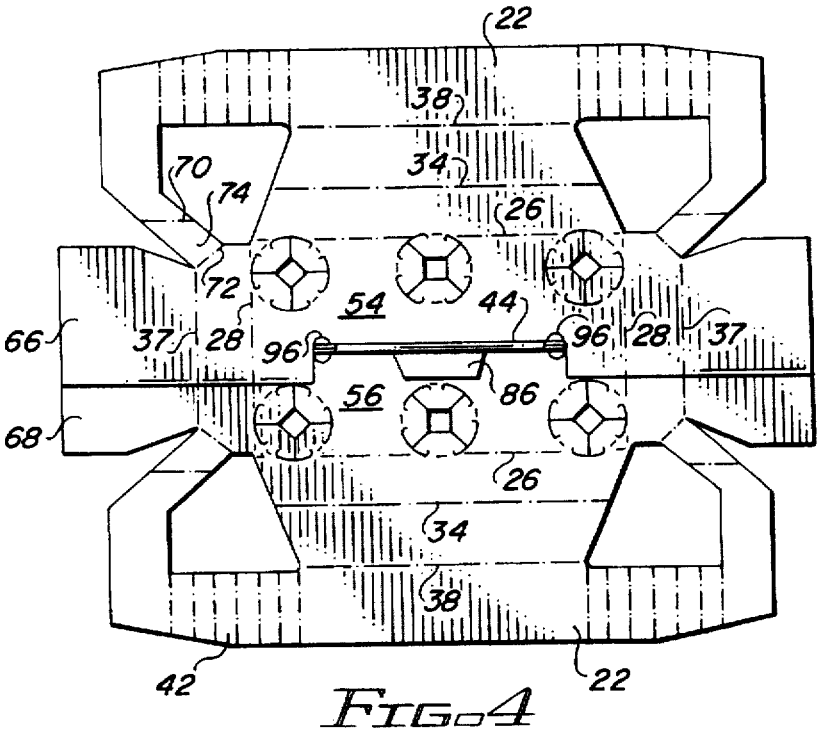
FIG. 4 is a plan view of the blank of FIG. 2 shown after initial folding and gluing steps have taken place.

To form a package, the blank is first folded and glued to the condition shown in FIG. 4. This is accomplished by folding the handle sections 48 and 50 up about their fold lines 58 and 60 while at the same time folding them down about their common fold line 52 until the handle sections are face to face. This moves the top panel sections 54 and 56 toward each other until the top panel section 54 and end panel flaps 66 partially overlap the top panel section 56 and end panel flaps 68 by an amount equal to the difference in width of the end panel flaps. Glue will have first been applied to the handle sections to adhered them to each other to form a two-ply handle. Glue also will have been applied to the top panel sections and the end panel flaps so that they are adhered to each other in the overlapping areas. Note that when the handle sections are folded up about the fold lines 58 and 60, the portions of the top panel sections vacated by the handle tabs 90 become cutouts in the top panel sections. When the carrier blank is in the condition shown in FIG. 4, the cutouts of the top panel section 54 are adjacent the cutouts of the top panel section 56, forming apertures 96.

Figure 5:
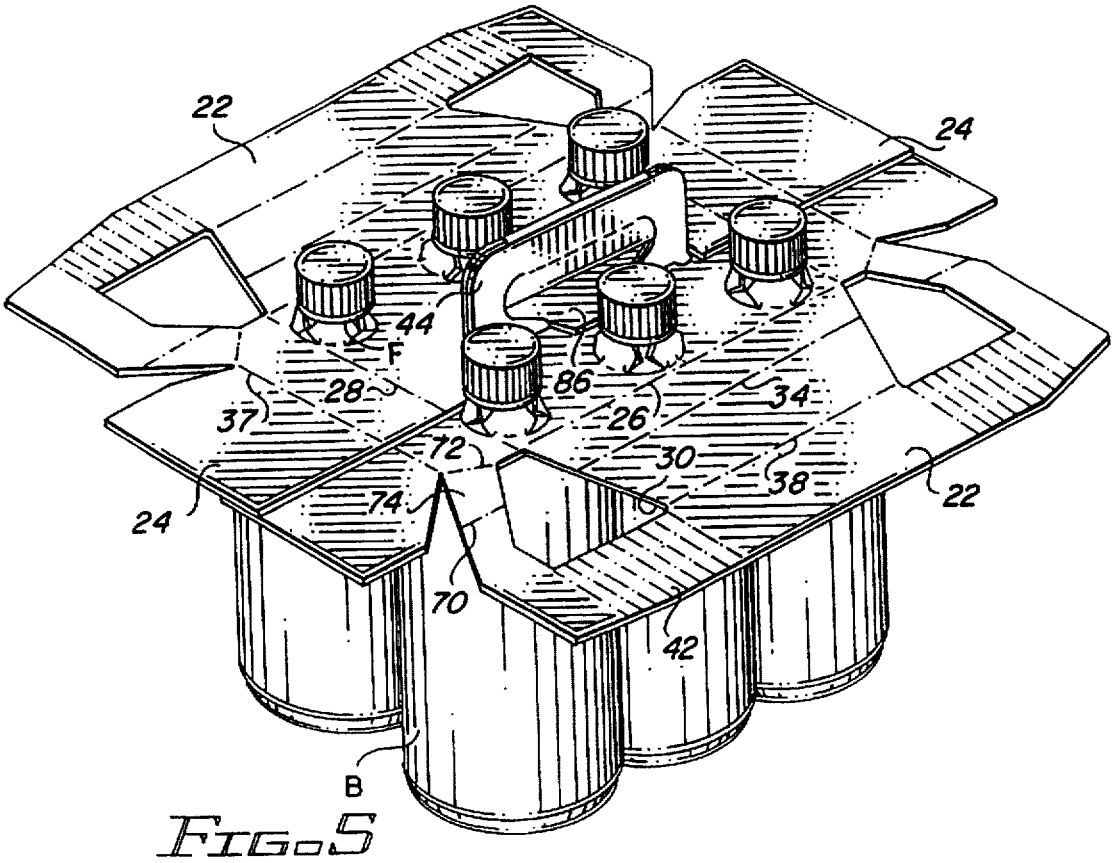
FIG. 5 is a pictorial view of the partially formed blank of FIG. 4 in place on a group of bottles to be packaged.
Figure 6:
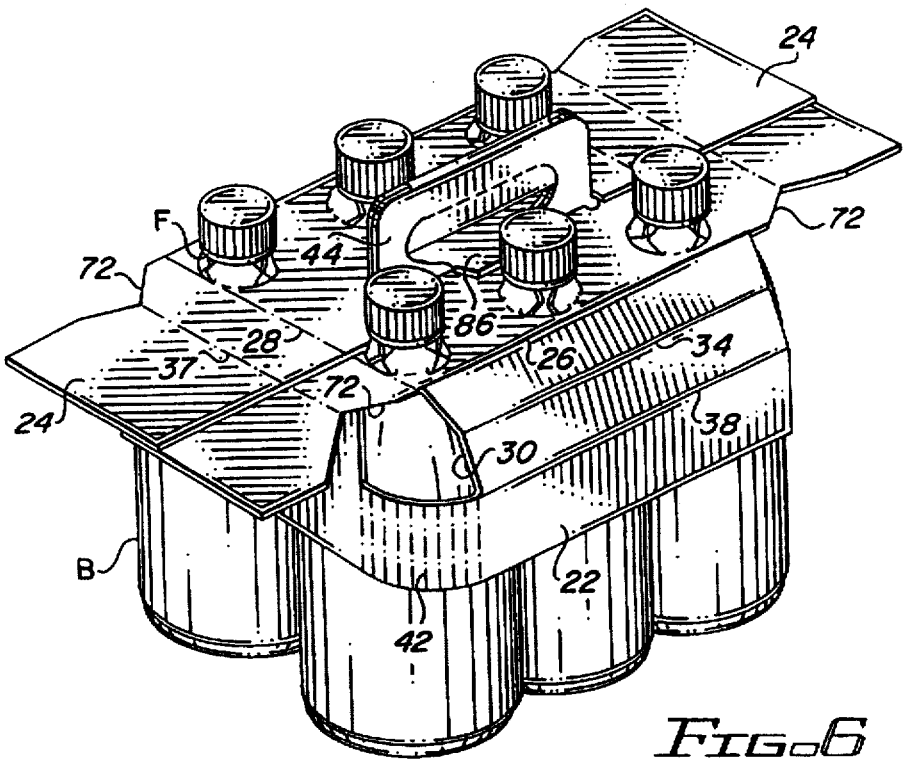
FIG. 6 is a pictorial view of the partially formed blank of FIG. 4 after initial folding steps have been made.

As shown in FIG. 5, the partially formed carrier blank is positioned on a group of bottles to be packaged so that the bottle neck openings are aligned with the bottles. The blank is then moved down over the bottle tops. As the bottle tops move relative to the bottle opening tabs 18, they contact the bottle tabs and pivot them up until the relatively large diameter bottle flanges F move past the tabs. At that point the tabs snap back into contact with the smaller diameter bottle neck adjacent the underside of the bottle flanges. Next, the gusset panels 74 are folded about fold lines 72 so as to contact the underside of the end panel flaps 66 and 68. This brings the fold lines 70 substantially directly beneath the fold lines 28 and causes the side panel extensions 42 to fold down about the gusset panel fold lines 70. The side panel sections are also folded down about the fold lines 34, causing the side panel extensions to curve around adjacent bottles. The carrier at this interim stage of fabrication is illustrated in FIG. 6. The end panel flaps 66 and 68 are then folded down and glued to the underlying portions of the side panel extensions to produce the final package shown in FIG. 1.

Figure 7:
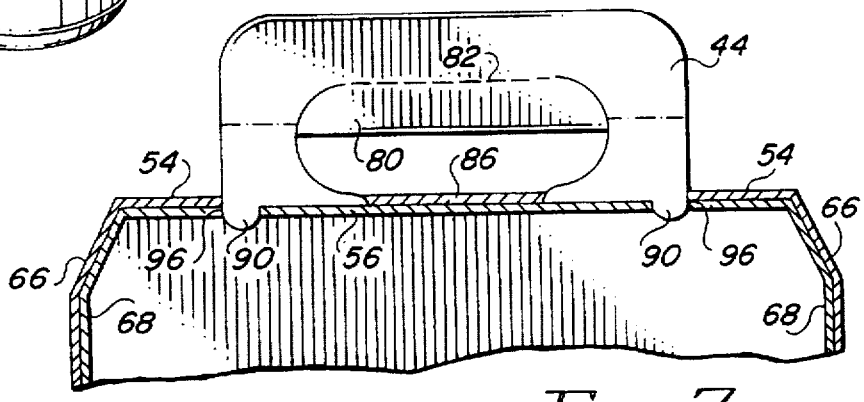
FIG. 7 is a partial transverse sectional view of the carrier taken along line 7—7 of FIG. 1, with the bottles removed for greater clarity.

As explained above, when the handle sections 48 and 50 are brought together to form the handle 44, they are folded up about the fold lines 58 and 60, respectively, and the top panel sections 54 and 56 are moved toward each other on the way to their overlapping relationship. As these steps take place the tabs 90 at the ends of the handle sections move with the pivoting handle sections, moving out of the plane of the top panel sections. In the final vertical position of the handle the tabs 90 extend down into the interior of the carrier through the apertures 96. This arrangement is shown in FIG. 7. The benefit of the arrangement is that it resists tearing of the handle at the outer ends of the fold line connections to the top panel. Handles which have outer vertical edges that meet the fold line connecting the handle to the top panel permit a horizontal pull to be exerted on the top panel adjacent the outer vertical edges when a carrier is lifted. This stress can cause the handle plies to pull apart or the top panel to tear at these critical areas. The invention overcomes the problem by causing the handle fold lines to terminate at the downwardly extending edges of the tabs 90, thereby not permitting the horizontal top panel sections to be subjected to significant horizontal stresses.

The handle is shown to include intermediate horizontal fold lines 94. Although not necessary to the invention, they preferably are provided to allow the handle to be folded down along these fold lines to enable the carriers to be stacked for shipping or display. The upper edge of the folded handle can then engage the underside of the flanges of adjacent bottles, which holds the handle in a position lower than the bottle tops.

The handle of the invention is not limited to use in a carrier of the type described. It could also be provided on carriers which extend over the tops of the packaged articles.

By locating the handle section fold lines 58 spaced from the inner edge of the top panel section 54 and the handle section fold lines 60 at the inner edge of the top panel section 56, the top panel section 54 can be made wide enough to partially overlap the top panel section 56. It will be understood that the integral tab 86 of the top panel section 56 is adhered to the inner face of the top panel section 54, while the tab 86 of the top panel section 54 overlies and is adhered to the top panel section 56, thus forming a strong top panel. By making the width of the integral tab 86 at the point where the tab passes over the longitudinal centerline of the carrier substantially the same as the distance between the legs 45 of the handle, the tab is able to absorb potential tearing stresses at the inner ends of the handle legs and prevent tearing at these points.

It can now be appreciated that the invention allows a carrier containing heavy loads to be provided with a suitcase-type handle without danger of the handle or top panel tearing. This has been accomplished without complicating the carrier fabrication process or increasing the cost of the carrier or the process.

It will be understood that the invention is not limited to all the specific details described in connection with the preferred embodiment, except as they may be within the scope of the appended claims. Changes to certain features of the preferred embodiment which do not alter the overall basic function and concept of the invention are therefore contemplated.

What is claimed is:

1. An article carrier, comprising:

a top panel having opposite side edges and opposite end edges, the top panel being connected at the side edges thereof to side panels;

a handle connected to the top panel by a fold line located substantially along a centerline of the carrier, the handle being comprised of a plurality of plies;

the handle fold line being substantially parallel to the side edges of the top panel and having opposite ends terminating at points spaced from the end edges of the top panel;

the top panel being comprised of a first top panel section which partially overlaps and is adhered to a second top panel section, each top panel section being connected by the handle fold line to a handle ply;

the top panel including apertures extending from the ends of the handle fold line toward the end edges of the top panel; and downwardly extending tabs at opposite ends of the handle extending through the apertures in the top panel into the interior of the carrier.

2. An article carrier as defined in claim 1, wherein the handle includes a substantially horizontal strap and two spaced legs forming an opening adjacent the strap, whereby a person lifting the carrier by the handle can grasp the strap.

3. An article carrier as defined in claim 2, wherein the handle fold line is comprised of two spaced fold line segments separated by the handle opening.

4. An article carrier as defined in claim 3, wherein the first top panel section includes an integral tab extending through the handle opening, the width of the integral tab at said centerline being substantially the same as the distance between the spaced legs of the handle.

5. An article carrier as defined in claim 1, including end panels connected to the top panel.

6. An article carrier as defined in claim 5, wherein each end panel is comprised of a first end panel flap which partially overlaps and is adhered to a second end panel flap, the first end panel flaps being connected to the first top panel section and the second end panel flaps being connected to the second top panel section.

7. An article carrier as defined in claim 1, wherein each aperture in the top panel is partially comprised of a cutout in the first top panel section and partially comprised of a cutout in the second top panel section, the cutout in the first top panel section meeting the cutout in the second top panel section to form the aperture.

8. An article carrier as defined in claim 7, wherein the first top panel section includes additional integral tabs which overlap the second top panel section outwardly of the handle, each additional tab having an edge extending from one of the cutouts in the first top panel section.

9. A blank for forming an article carrier, comprising:

a first handle section connected to a substantially similar second handle section along a central fold line, each handle section having opposite end edges;

a first top panel section connected to the first handle section along a first fold line and a second top panel section connected to the second handle section along a second fold line;

a slit extending from each end edge of the first handle section into the first top panel section, and a slit extending from each end edge of the second handle section into the second top panel section; and each slit extending beyond the associated first or second fold line and including a transverse portion which terminates at the associated first or second fold line to define a handle tab;

the transverse portions of the slits forming cutouts in the first and second top panel sections in a carrier formed from the blank so as to receive the handle tabs of such a carrier.

10. A carrier blank as defined in claim 9, wherein the first top panel section is of greater width than the second top panel section and wherein the first and second top panel sections have inner edges, the second fold line substantially coinciding with the inner edge of the second top panel section and the first fold line being spaced from the inner edge of the first top panel section.

11. A carrier blank as defined in claim 9, wherein each handle section includes a strap and an opening between the strap and the inner edge of the associated top panel section.

12. A carrier blank as defined in claim 11, wherein each top panel section includes a tab extending into the handle section opening associated with the top panel section.

13. A carrier blank as defined in claim 11, wherein each of the first and second fold lines is comprised of two spaced fold line segments separated by the associated handle section opening.

14. A carrier blank as defined in claim 9, wherein the first and second top panel sections include bottle neck openings.

15. A carrier blank as defined in claim 9, including an end panel flap connected to each of the first and second top panel sections at opposite ends thereof.

* * * * *